US010221009B1

(12) United States Patent
Beirlair, Sr. et al.

(10) Patent No.: US 10,221,009 B1
(45) Date of Patent: Mar. 5, 2019

(54) GARBAGE CAN RETENTION ASSEMBLY

(71) Applicants: Michael Beirlair, Sr., Houtzdale, PA (US); Michael Beirlair, Jr., Houtzdale, PA (US)

(72) Inventors: Michael Beirlair, Sr., Houtzdale, PA (US); Michael Beirlair, Jr., Houtzdale, PA (US)

( * ) Notice: Subject to any disclaimer, the term of this patent is extended or adjusted under 35 U.S.C. 154(b) by 0 days.

(21) Appl. No.: 15/947,004

(22) Filed: Apr. 6, 2018

(51) Int. Cl.
*A47F 5/12* (2006.01)
*B65F 1/14* (2006.01)

(52) U.S. Cl.
CPC ..... *B65F 1/141* (2013.01)

(58) Field of Classification Search
CPC ..... B65F 1/141
USPC ..... 248/146, 156, 133, 907; 211/85.19
See application file for complete search history.

(56) References Cited

U.S. PATENT DOCUMENTS 2,260,570 A 10/1941 John
2,471,257 A * 5/1949 Blank ..... B65F 1/141 248/146
3,201,075 A * 8/1965 Sievers ..... B65F 1/1421 248/146
3,935,964 A * 2/1976 Saxe ..... B65F 1/141 220/318
7,654,407 B1 * 2/2010 Obrecht ..... B65F 1/141 220/475
8,833,710 B1 * 9/2014 Atkinson ..... B65F 1/141 248/146

* cited by examiner

*Primary Examiner* — Todd M Epps

(57) ABSTRACT

A garbage can retention assembly for inhibiting a garbage can from being opened or moved includes a mount that is removably coupled to a stanchion. An extension arm is pivotally coupled to the mount and the extension arm is positionable in a first position to extend over a lid of a garbage can that is positioned adjacent to the stanchion. An engaging member is coupled to the extension arm. The engaging member frictionally engages the lid of the garbage can when the extension arm is in the first position. A handle is coupled to the extension arm for manipulating the extension arm between the first position and the second position. A grapple is movably coupled to the handle. The grapple is biased into a gripping position for engaging a handle of the garbage can when the extension arm is in the first position to inhibit the garbage can from moving.

14 Claims, 4 Drawing Sheets

GARBAGE CAN RETENTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to retention devices and more particularly pertains to a new retention device for inhibiting a garbage can from being opened or moved.

BRIEF SUMMARY OF THE INVENTION

An embodiment of the disclosure meets the needs presented above by generally comprising a mount that is removably coupled to a stanchion. An extension arm is pivotally coupled to the mount and the extension arm is positionable in a first position to extend over a lid of a garbage can that is positioned adjacent to the stanchion. An engaging member is coupled to the extension arm. The engaging member frictionally engages the lid of the garbage can when the extension arm is in the first position. A handle is coupled to the extension arm for manipulating the extension arm between the first position and the second position. A grapple is movably coupled to the handle. The grapple is biased into a gripping position for engaging a handle of the garbage can when the extension arm is in the first position to inhibit the garbage can from moving.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
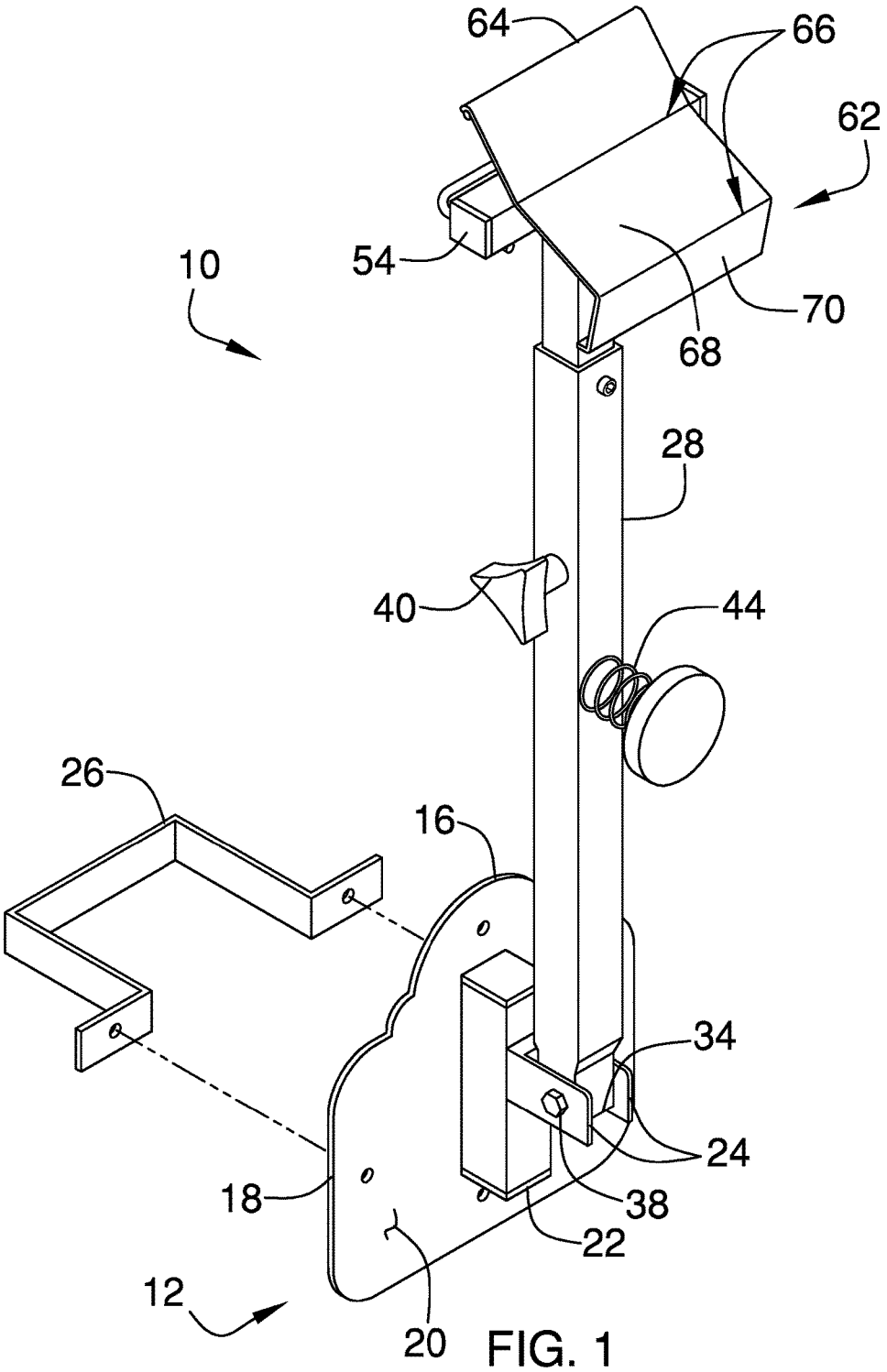
FIG. 1 is an exploded perspective view of a garbage can retention assembly according to an embodiment of the disclosure showing an extension arm in a second position.
Figure 2:
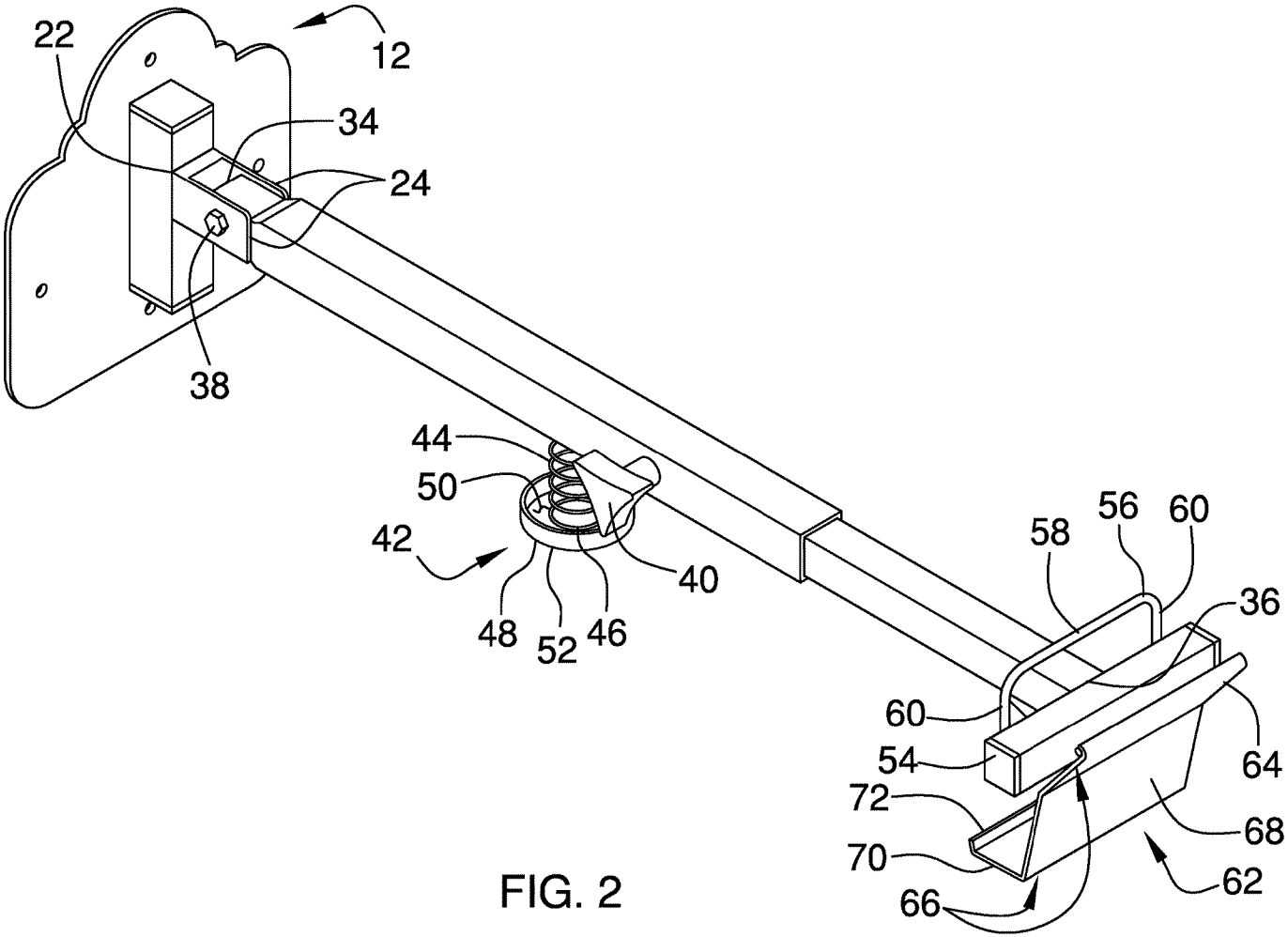
FIG. 2 is a perspective view of an embodiment of the disclosure showing an extension arm in a first position.
Figure 3:
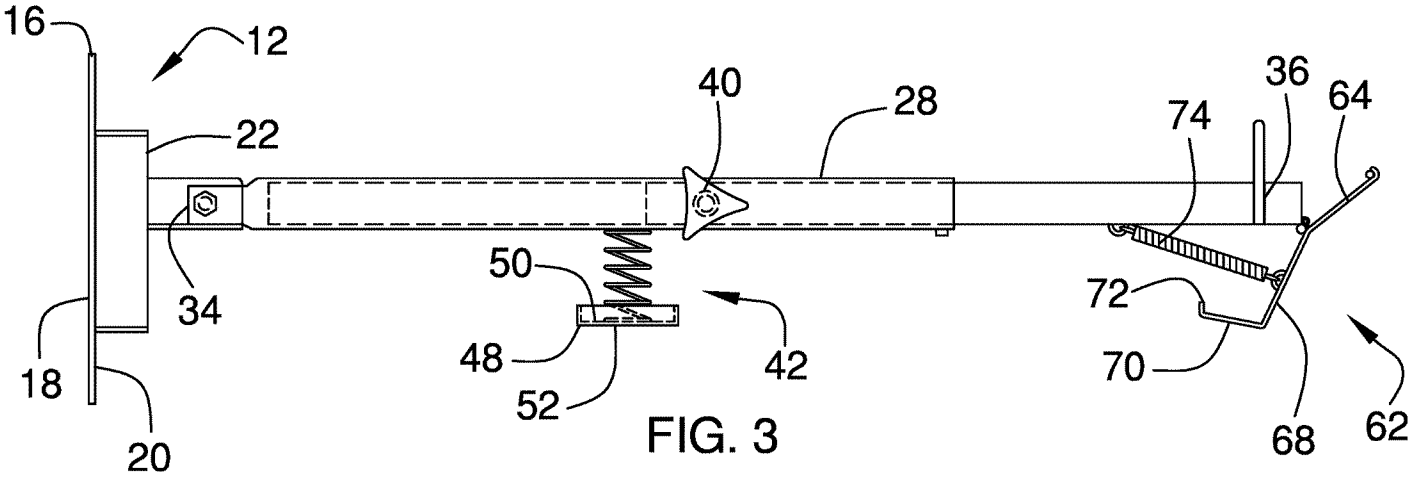
FIG. 3 is a right side phantom view of an embodiment of the disclosure.
Figure 4:
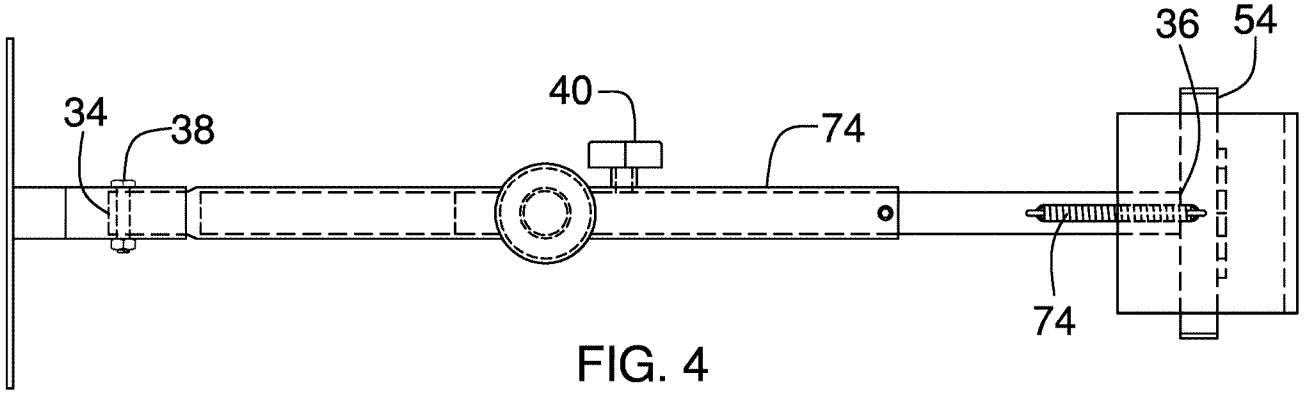
FIG. 4 is a bottom phantom view of an embodiment of the disclosure.
Figure 5:
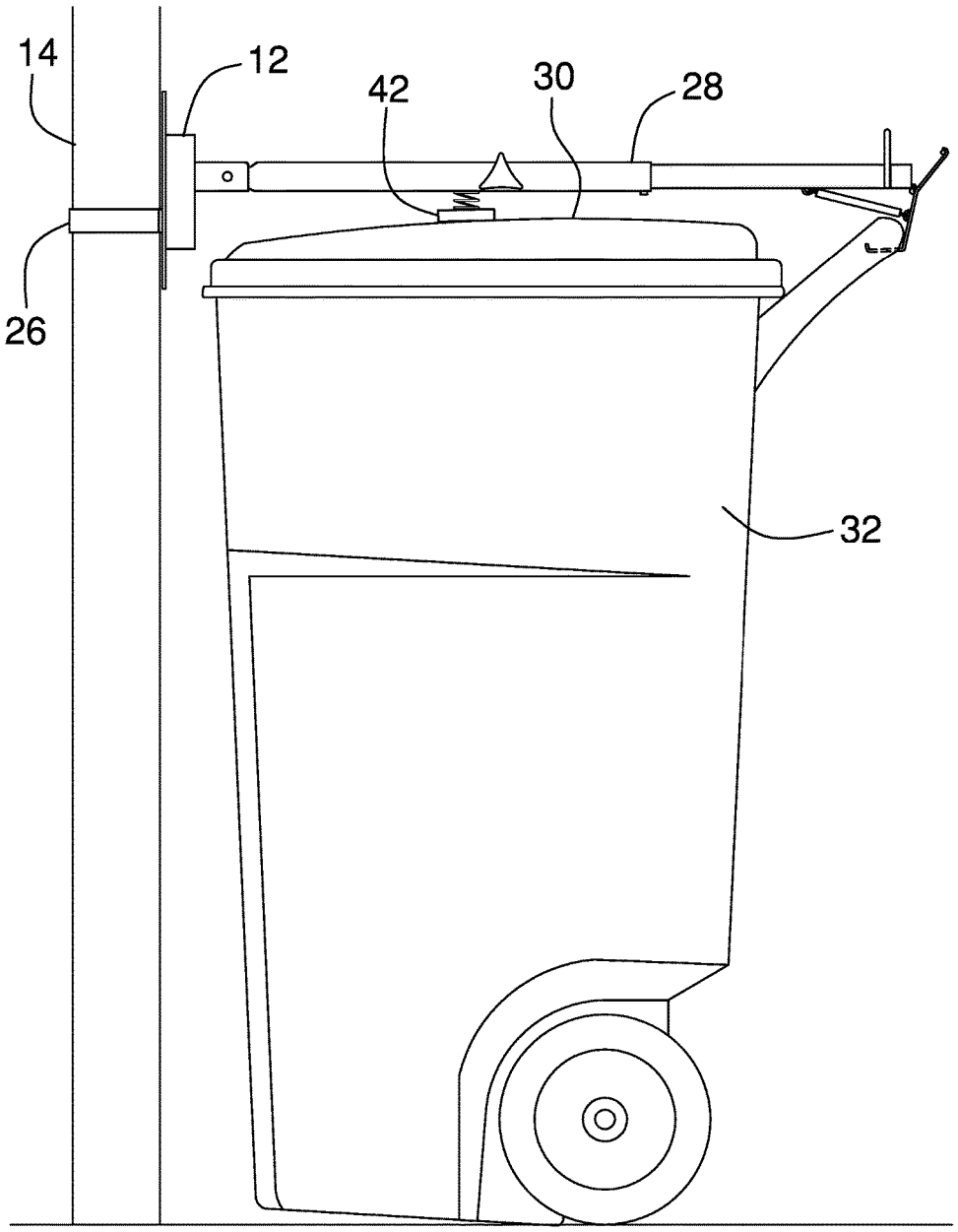
FIG. 5 is a perspective in-use view of an embodiment of the disclosure.

With reference now to the drawings, and in particular to FIGS. 1 through 5 thereof, a new retention device embodying the principles and concepts of an embodiment of the disclosure and generally designated by the reference numeral 10 will be described.

As best illustrated in FIGS. 1 through 5, the garbage can retention assembly 10 generally comprises a mount 12 that is removably coupled to a stanchion 14, such as a telephone pole, a fence post or other stanchion 14 commonly found near a residential structure. The mount 12 comprises a plate 16 that has a first surface 18 and a second surface 20, and the first surface 18 abuts the stanchion 14. An upper edge of the plate 16 may be scalloped to give the plate 16 an enhanced ornamental appearance. A pivot 22 is coupled to and extends away from the second surface of the plate 16, and the pivot 22 includes a pair of members 24 that are spaced apart from each other. A bracket 26 is provided and the bracket 26 is positioned around the stanchion 14. The bracket 26 engages the first surface 18 of the plate 16 to retain each of the plate 16 and the pivot 22 at a selected point on the stanchion 14. The bracket 26 may retained on the plate 16 with fasteners, such as bolts or the like.

An extension arm 28 is provided and the extension arm 28 is pivotally coupled to the mount 12. The extension arm 28 is positionable in a first position having the extension arm 28 being horizontally oriented. In this way the extension arm 28 can extend over a lid 30 of a garbage can 32 that is positioned adjacent to the stanchion 14. The extension arm 28 is positionable in a second position having the extension arm 28 being vertically oriented. The extension arm 28 has a first end 34 and a second end 36, the extension arm 28 is telescopic such that the extension arm 28 has an adjustable length. The first end 34 of the extension arm 28 is positioned between the pair of members 24 of the bracket 26.

A pin 38 extends through each of the members 24 of the bracket 26 and the extension arm 28 such that the extension arm 28 is pivotally retained on the bracket 26. A lock 40 is movably coupled to the extension arm 28. The lock 40 is urgeable into a locked position to retain the extension arm 28 at a selected length. Additionally, the lock 40 is urgeable into an unlocked position to facilitate the length of the extension arm 28 to be adjusted. The lock 40 may comprise a screw that frictionally engages a sliding portion of the extension arm 28 or the like.

An engaging member 42 is coupled to the extension arm 28. The engaging member 42 frictionally engages the lid 30 of the garbage can 32 when the extension arm 28 is in the first position. In this way the extension arm 28 retains the lid 30 of the garbage can 32 in a closed position. The engaging unit includes a biasing member 44 that extends downwardly from the extension arm 28. The biasing member 44 has a distal end 46 with respect to the extension arm 28 and the biasing member 44 may comprise a spring 74, a piston and any other compressible biasing member 44. The engaging member 42 further includes a disk 48 that has a first surface 50 and a second surface 52. The first surface 50 of the disk 48 is coupled to the distal end 46 of the biasing member 44 and the second surface 52 of the disk 48 frictionally engages the lid 30 of the garbage can 32.

A handle 54 is coupled to the extension arm 28 for manipulating the extension arm 28 between the first position and the second position. The handle 54 is aligned with the second end 36 of the extension arm 28 and the handle 54 is oriented transverse with the extension arm 28. The handle 54 may include a rod 56 that includes a central portion 58 extending between a pair of end portions 60. Each of the end portions 60 may be coupled to the handle 54 having the central portion 58 being spaced from and being collinear with the handle 54 for gripping the central portion 58.

A grapple 62 is provided and the grapple 62 is movably coupled to the handle 54. The grapple 62 is biased into a gripping position having the grapple 62 engaging a handle 54 of the garbage can 32 when the extension arm 28 is in the first position. Thus, the extension arm 28 inhibits the garbage can 32 from moving. The grapple 62 is manipulated into a releasing position having the grapple 62 disengaging the handle 54 of the garbage can 32 thereby facilitating the garbage can 32 to be moved.

The grapple 62 comprises a panel 64 that has a plurality of bends 66 thereon to define a leg portion 68 and a foot portion 70. The leg portion 68 is hingedly coupled to the handle 54 having the foot portion 70 being spaced downwardly from the handle 54 and being oriented collinear with the handle 54. The foot portion 70 includes a lip 72 extending upwardly therefrom and the lip 72 is spaced distally from the leg portion 68. The foot portion 70 is positioned beneath the handle 54 of the garbage can 32 when the grapple 62 is positioned in the gripping position. Thus, the grapple 62 engages the handle 54 of the garbage can 32. The foot portion 70 is moved from beneath the handle 54 of the garbage can 32 when the grapple 62 is positioned in the releasing position. A spring 74 is coupled between the extension arm 28 and the leg portion 68 of the panel 64 to bias the foot portion 70 to engage the handle 54 of the garbage can 32.

In use, the mount 12 is attached to the stanchion 14 or vertical support surface, such as a wall or the like, and the mount 12 is positioned at a height such that the engaging member 42 engages the lid 30 of the garbage can 32 when the extension arm 28 is in the first position. Additionally, the grapple 62 engages the handle 54 of the garbage can 32 when the extension arm 28 is positioned in the first position. In this way the garbage can 32 is inhibited from being moved and the lid 30 on the garbage can 32 is inhibited from being opened. The grapple 62 is manipulated into the releasing position to disengage the handle 54 of the garbage can 32 and facilitate the extension arm 28 to be raised into the second position. In this way the garbage can 32 is freely movable and the lid 30 of the garbage can 32 may be opened.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage can retention assembly being configured to connect a garbage can to a stanchion, said assembly comprising:

a mount being removably coupled to the stanchion;

an extension arm being pivotally coupled to said mount, said extension arm being positionable in a first position having said extension arm being horizontally oriented wherein said extension arm is configured to extend over a lid of a garbage can that is positioned adjacent to the stanchion;

an engaging member being coupled to said extension arm, said engaging member being engaged to the lid of the garbage can when said extension arm is in said first position wherein said extension arm is configured to retain the lid in a closed position;

a handle being coupled to said extension arm for manipulating said extension arm between said first position and a second position; and a grapple being movably coupled to said handle, said grapple being biased into a gripping position wherein said grapple is engaged to a handle of the garbage can when said extension arm is in said first position wherein said extension arm is configured to inhibit the garbage can from moving.

2. The assembly according to claim 1, wherein said mount comprises a plate having a first surface and a second surface, said first surface being abutted to said stanchion.

3. The assembly according to claim 2, further comprising a pivot being coupled to and extending away from said second surface of said plate, said pivot including a pair of members being spaced apart from each other.

4. The assembly according to claim 3, further comprising a bracket being positioned around the stanchion, said bracket being engaged to said first surface of said plate to retain each of said plate and said pivot at a selected point on the stanchion.

5. The assembly according to claim 4, wherein said extension arm has a first end and a second end, said first end being positioned between said pair of members of said bracket, said extension arm being telescopic such that said extension arm has an adjustable length.

6. The assembly according to claim 5, further comprising a pin extending through each of said members of said bracket and said extension arm such that said extension arm is pivotally retained on said bracket.

7. The assembly according to claim 5, wherein said handle is aligned with said second end of said extension arm, said handle being oriented transverse with said extension arm.

8. The assembly according to claim 7, wherein said grapple comprises a panel having a plurality of bends thereon to define a leg portion and a foot portion, said leg portion being hingedly coupled to said handle having said foot portion being spaced downwardly from said handle and having said foot portion being oriented collinear with said handle.

9. The assembly according to claim 8, wherein said foot portion includes a lip extending upwardly therefrom and being spaced distally from said leg portion, said foot portion being positioned beneath the handle of the garbage can when said grapple is positioned in said gripping position, said foot portion being moved from beneath the handle of the garbage can when said grapple is positioned in a releasing position.

10. The assembly according to claim 9, further comprising a spring being coupled between said extension arm and said leg portion of said panel such that said spring biases said foot portion to engage the handle of the garbage can.

11. The assembly according to claim 1, further comprising a lock being movably coupled to said extension arm, said lock being urgeable into a locked position to retain said extension arm at a selected length, said lock being urgeable into an unlocked position to facilitate the length of said extension arm to be adjusted.

12. The assembly according to claim 1, wherein said engaging member comprises a biasing member extending downwardly from said extension arm, said biasing member having a distal end with respect to said extension arm.

13. The assembly according to claim 12, further comprising a disk having a first surface and a second surface, said first surface of said disk being coupled to said distal end of said biasing member, said second surface of said disk being engaged to the lid of the garbage can.

14. A garbage can retention assembly being configured to connect a garbage can to a stanchion, said assembly comprising:

a mount being removably coupled to the stanchion, said mount comprising:

a plate having a first surface and a second surface, said first surface being abutted to said stanchion;

a pivot being coupled to and extending away from said second surface of said plate, said pivot including a pair of members being spaced apart from each other; and a bracket being positioned around the stanchion, said bracket being engageable to said first surface of said plate to retain each of said plate and said pivot at a selected point on the stanchion;

an extension arm being pivotally coupled to said mount, said extension arm being positionable in a first position having said extension arm being horizontally oriented wherein said extension arm is configured to extend over a lid of a garbage can that is positioned adjacent to the stanchion, said extension arm being positionable in a second position having said extension arm being vertically oriented, said extension arm having a first end and a second end, said extension arm being telescopic such that said extension arm has an adjustable length, said first end being positioned between said pair of members of said bracket;

a pin extending through each of said members of said bracket and said extension arm such that said extension arm is pivotally retained on said bracket;

a lock being movably coupled to said extension arm, said lock being urgeable into a locked position to retain said extension arm at a selected length, said lock being urgeable into an unlocked position to facilitate the length of said extension arm to be adjusted;

an engaging member being coupled to said extension arm, said engaging member being engaged to the lid of the garbage can when said extension arm is in said first position wherein said extension arm is configured to retain the lid in a closed position, said engaging member comprising:

a biasing member extending downwardly from said extension arm, said biasing member having a distal end with respect to said extension arm; and a disk having a first surface and a second surface, said first surface of said disk being coupled to said distal end of said biasing member, said second surface of said disk being engaged to the lid of the garbage can;

a handle being coupled to said extension arm for manipulating said extension arm between said first position and said second position, said handle being aligned with said second end of said extension arm, said handle being oriented transverse with said extension arm; and a grapple being movably coupled to said handle, said grapple being biased into a gripping position having said grapple being engaged to a handle of the garbage can when said extension arm is in said first position wherein said extension arm is configured to inhibit the garbage can from moving, said grapple being manipulated into a releasing position having said grapple being disengaged from the handle of the garbage can, said grapple comprising:

a panel having a plurality of bends thereon to define a leg portion and a foot portion, said leg portion being hingedly coupled to said handle having said foot portion being spaced downwardly from said handle and having said foot portion being oriented collinear with said handle, said foot portion including a lip extending upwardly therefrom and being spaced distally from said leg portion, said foot portion being positioned beneath the handle of the garbage can when said grapple is positioned in said gripping position, said foot portion being moved from beneath the handle of the garbage can when said grapple is positioned in said releasing position; and a spring being coupled between said extension arm and said leg portion of said panel such that said spring biases said foot portion to engage the handle of the garbage can.

* * * * *